US009925581B2

(12) United States Patent
Lin

(10) Patent No.: US 9,925,581 B2
(45) Date of Patent: Mar. 27, 2018

(54) PROCESS OF MANUFACTURING WRENCHES

(71) Applicant: Chen Chih Lin, New Taipei (TW)

(72) Inventor: Chen Chih Lin, New Taipei (TW)

( * ) Notice: Subject to any disclaimer, the term of this patent is extended or adjusted under 35 U.S.C. 154(b) by 0 days.

(21) Appl. No.: 15/347,866

(22) Filed: Nov. 10, 2016

(65) Prior Publication Data

US 2017/0056962 A1 Mar. 2, 2017

(51) Int. Cl.

| | |
|---|---|
| ***B21K 5/16*** | (2006.01) |
| ***B22F 3/10*** | (2006.01) |
| ***B22F 3/24*** | (2006.01) |
| *B22F 5/00* | (2006.01) |
| *B21D 41/02* | (2006.01) |

(52) U.S. Cl.

CPC ..... *B21K 5/16* (2013.01); *B22F 3/1017* (2013.01); *B22F 3/24* (2013.01); *B21D 41/02* (2013.01); *B22F 2005/002* (2013.01); *B22F 2998/10* (2013.01)

(58) Field of Classification Search

CPC . B21K 5/16; B22F 3/1017; B22F 3/24; B22F 2005/002; B22F 2998/10; B21D 41/02

USPC ..... 76/114

See application file for complete search history.

(56) References Cited

U.S. PATENT DOCUMENTS

| | | | | |
|---|---|---|---|---|
| 5,083,008 | A * | 1/1992 | Zerver | B21J 5/02 219/121.69 |
| 2006/0185476 | A1* | 8/2006 | Lin | B21K 5/16 76/114 |
| 2007/0181635 | A1* | 8/2007 | Otaki | B21J 5/00 228/101 |
| 2010/0043601 | A1* | 2/2010 | Hu | B21J 5/02 76/114 |
| 2013/0040261 | A1* | 2/2013 | Kwon | A61C 3/03 433/102 |
| 2016/0158827 | A1* | 6/2016 | Chen | B21K 5/16 76/119 |
| 2016/0236266 | A1* | 8/2016 | Chen | B21K 5/16 |

* cited by examiner

*Primary Examiner* — Omar Flores Sanchez

(57) ABSTRACT

A processes of manufacturing wrenches is provided with preparing a cylinder of raw material; cutting the cylinder of raw material into cylindrical first half-finished products; increasing volumes of two one ends of each first half-finished product 10-18% by compressing to form a second half-finished product having two spheres at two ends respectively; pressing each sphere to form top and bottom flats on the ends of the second half-finished product respectively; sintering the second half-finished product; placing the second half-finished product in a die; forging the second half-finished product to form a third half-finished product; and punching the third half-finished product to form a finished wrench having an open end and a box end.

1 Claim, 8 Drawing Sheets

PROCESS OF MANUFACTURING WRENCHES

BACKGROUND OF THE INVENTION

1. Field of the Invention

The invention relates to processes of manufacturing wrenches and more particularly to a process of manufacturing wrenches without leaving excess material.

2. Description of Related Art

Conventional processes of manufacturing wrenches are disadvantages because excess material is left.

Thus, the need for improvement still exists.

SUMMARY OF THE INVENTION

It is therefore one object of the invention to provide a process of manufacturing wrenches, the process comprising preparing a cylinder of raw material; cutting the cylinder of raw material into a plurality of cylindrical first half-finished products; increasing volumes of two one ends of each first half-finished product 10-18% by compressing to form a second half-finished product having two spheres at two ends respectively; pressing each sphere to form top and bottom flats on the ends of the second half-finished product respectively; sintering the second half-finished product; placing the second half-finished product in a die; forging the second half-finished product to form a third half-finished product; and punching the third half-finished product to form a finished wrench having an open end and a box end.

The above and other objects, features and advantages of the invention will become apparent from the following detailed description taken with the accompanying drawings.

DETAILED DESCRIPTION OF THE INVENTION

Figure 1:
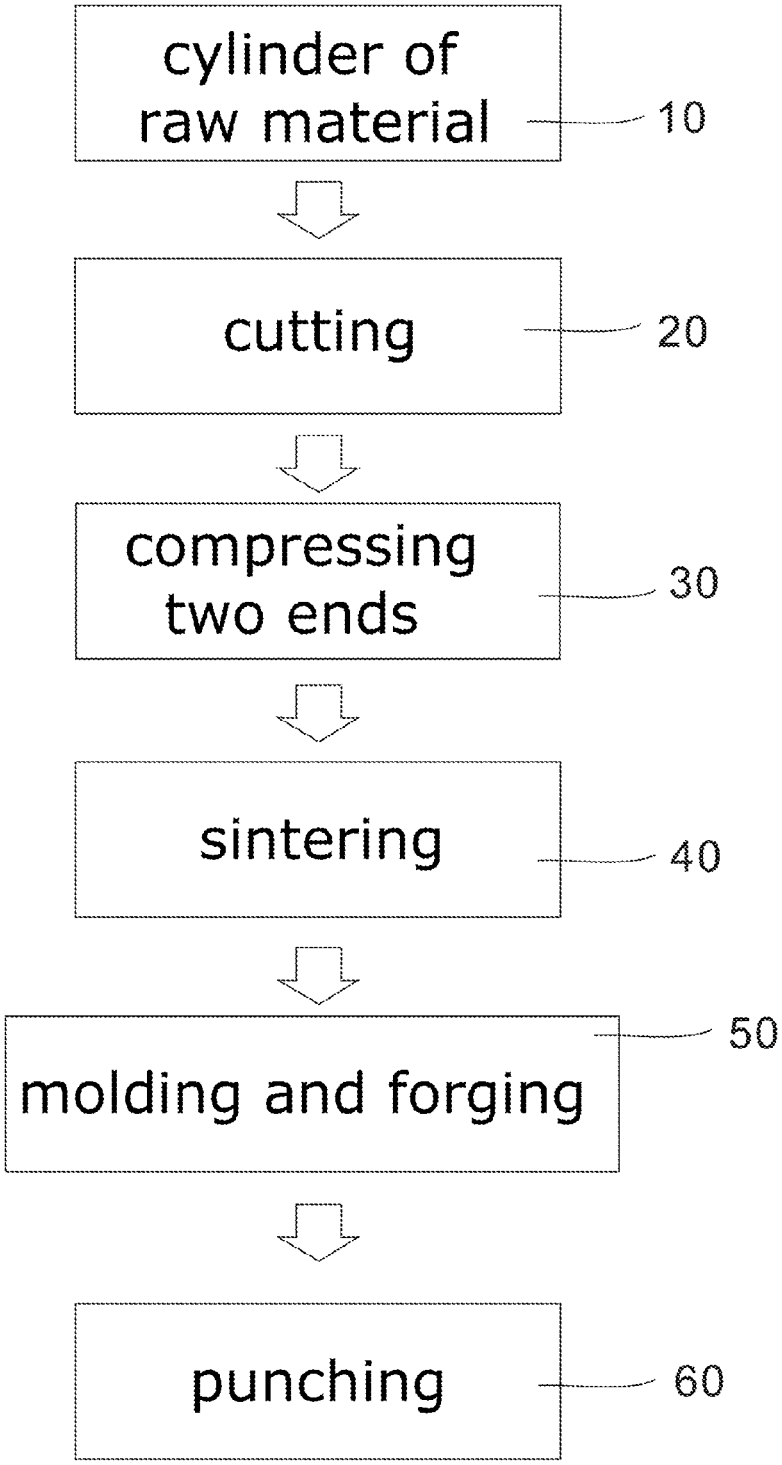
FIG. 1 is a flow chart illustrated a process of manufacturing wrenches without according to the invention.
Figure 2:
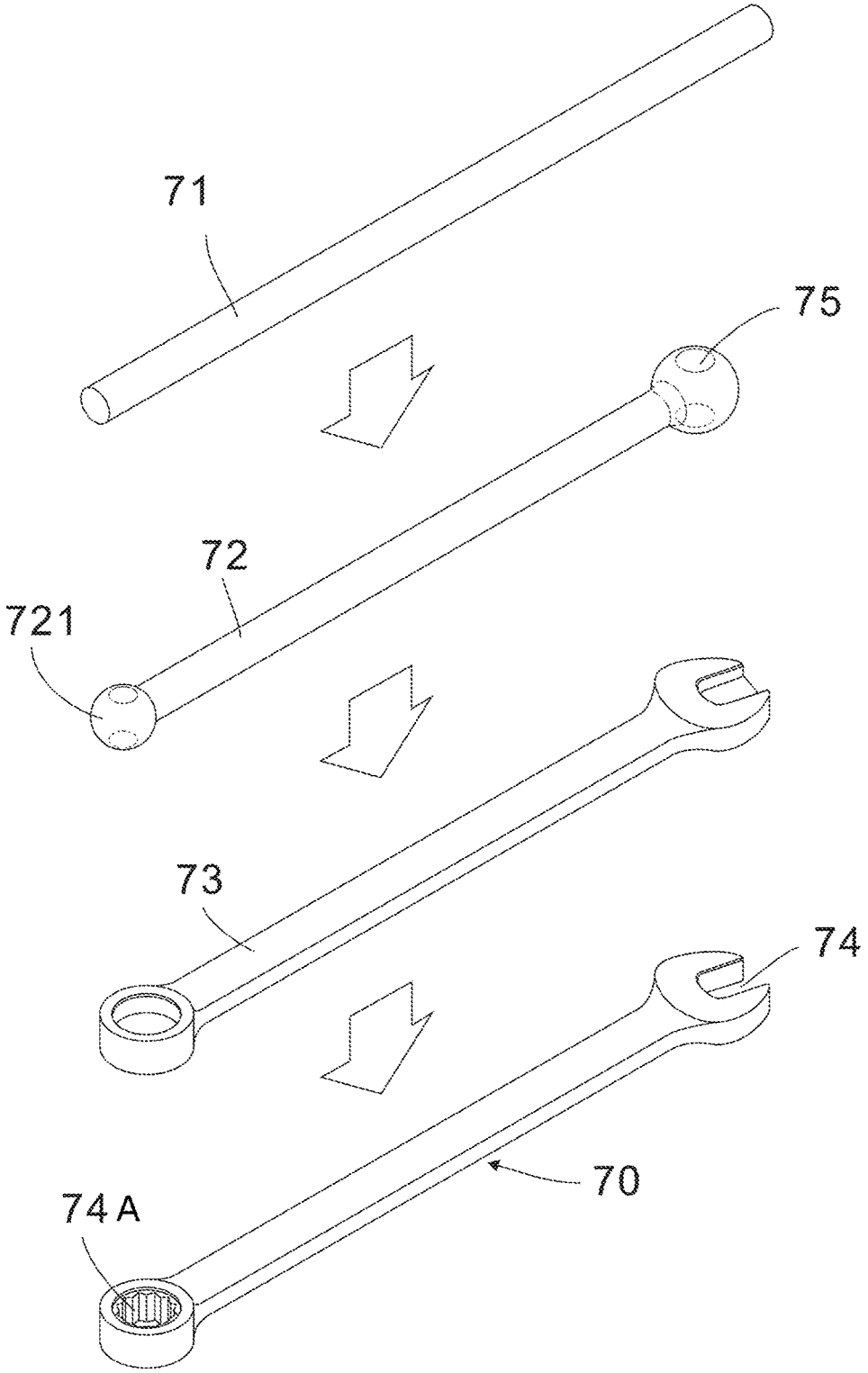
FIG. 2 schematically depicts members corresponding to the process.
Figure 9:
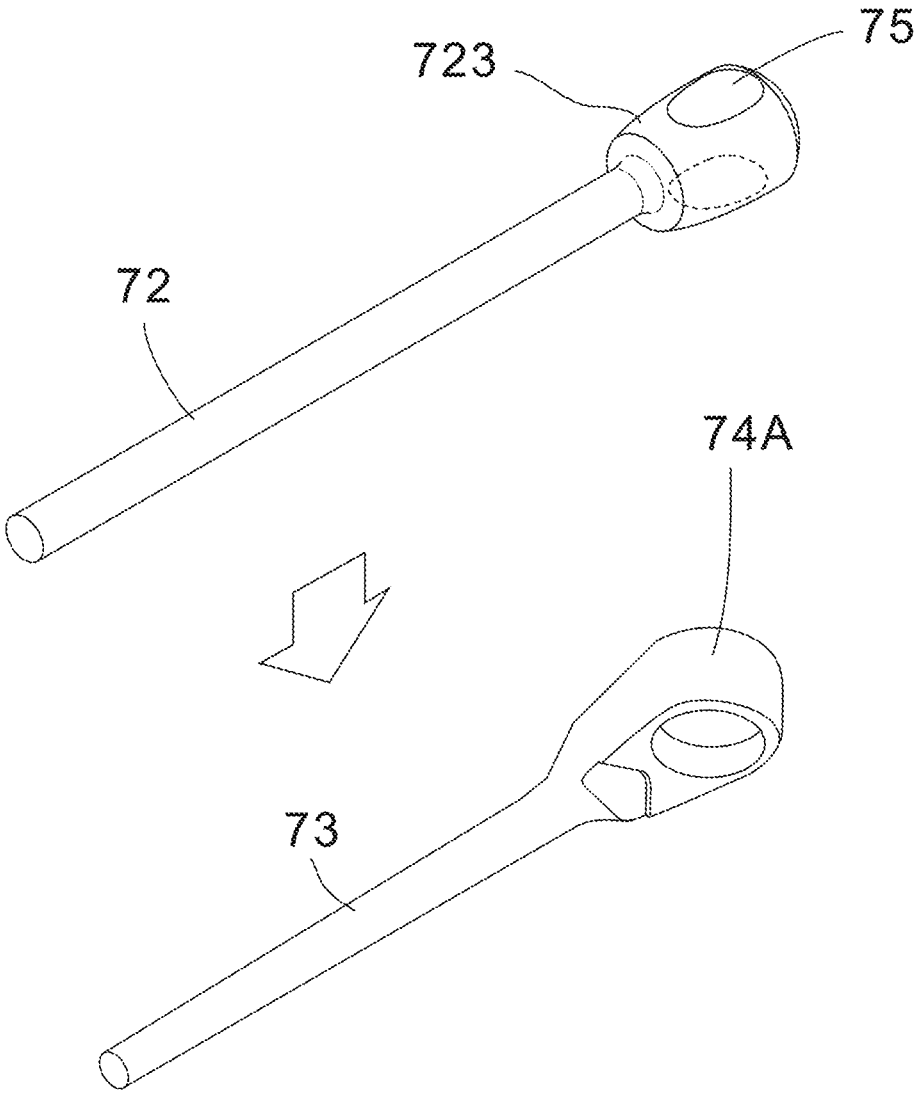
FIG. 9 schematically shows the second half-finished product having the other end shaped as a cylinder having a bulged intermediate portion, and top and bottom flats, and the second half-finished product formed as the third half-finished product having a half-finished box end.

Referring to FIGS. 1 and 9, a process of manufacturing wrench in accordance with the invention illustrated. The process comprises the following steps as discussed in detail below.

In step 10, a cylinder of raw material is prepared.

In step 20, the cylinder of raw material is cut into a plurality of cylindrical first half-finished products 71.

In step 30, volumes of two one ends of each first half-finished product 71 are increased 10-18% by compressing to form a second half-finished product 72 having two spheres 721 at two ends respectively, each sphere 721 being pressed to form top and bottom flats 75.

In step 40, each second half-finished product 72 is sintered to reduce the porosity and enhance the strength.

In step 50, each second half-finished product 72 is placed in a mold 81 with the flats 50 being for positioning purpose, and each second half-finished product 72 is forged to form a third half-finished product 73 shaped as a half-finished wrench.

In step 60, each third half-finished product 73 is punched to form a finished wrench 70 having an open end 74 and a box end 74A.

It is envisaged by the invention that excess material is not left in the process.

Figure 3A:
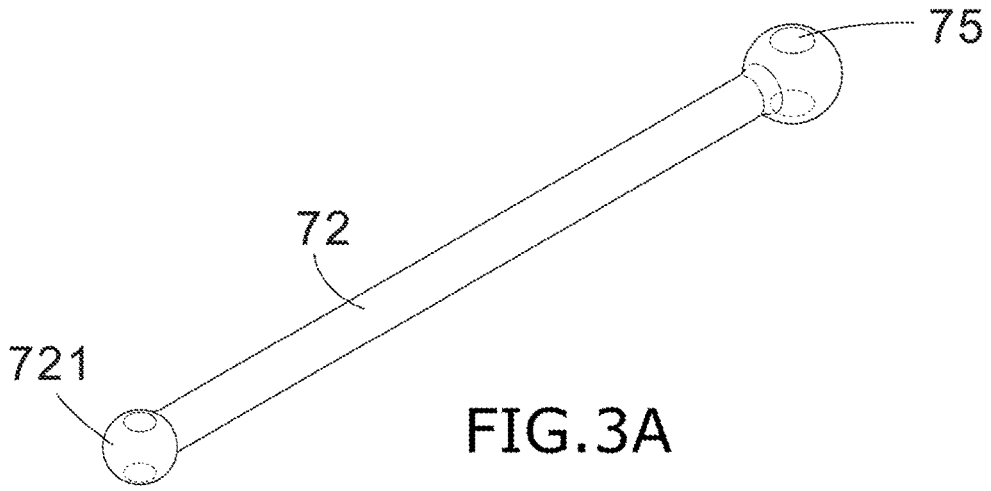
FIG. 3A is a perspective view of the second half-finished product.
Figure 3B:
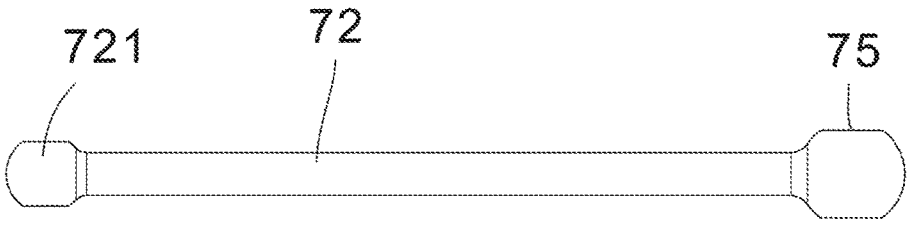
FIG. 3B is a side elevation of the second half-finished product.
Figure 3C:
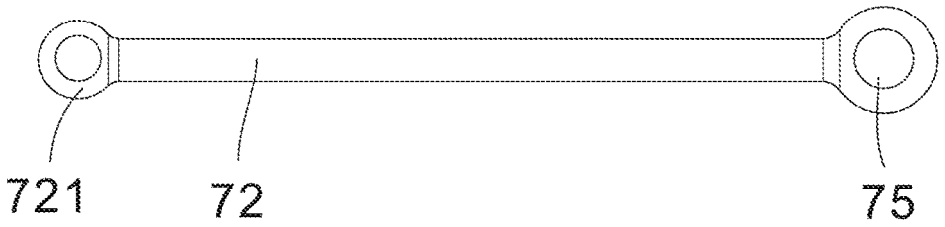
FIG. 3C is a top view of the second half-finished product.

FIGS. 3A, 3B and 3C are perspective view, side elevation, and top view of the second half-finished product 72 respectively.

Figure 4A:
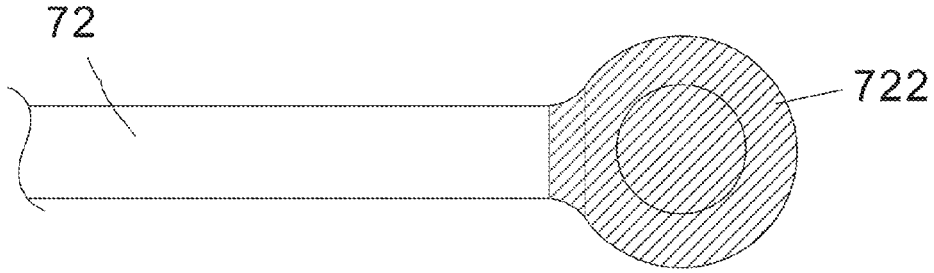
FIGS. 4A and 4B show volumes of one end of the second half-finished product increased 10-18% respectively.
Figure 4B:
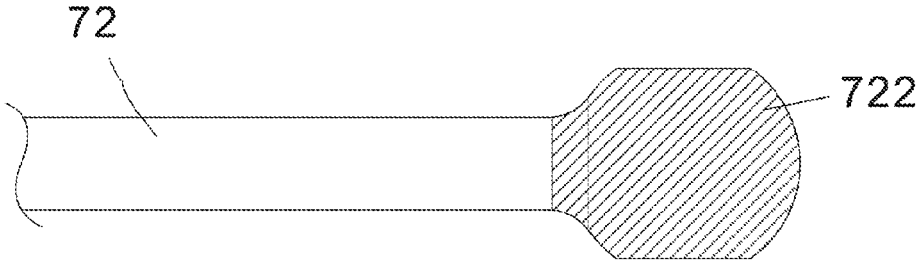

As shown in FIGS. 4A and 4B, inclined lines 722 show volumes of one end of the second half-finished product 72 are increased 10-18%.

Figure 5A:
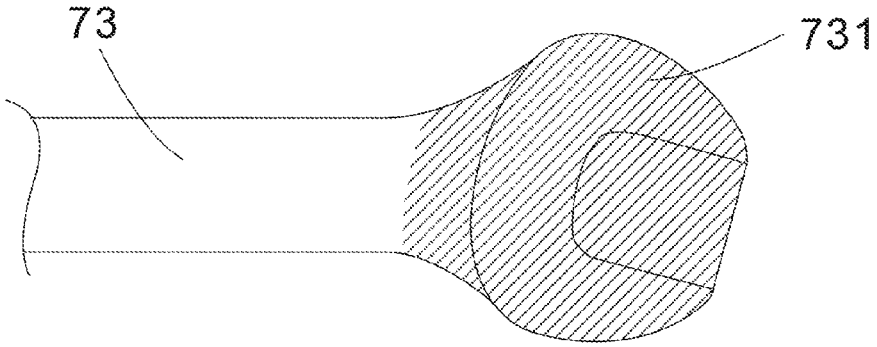
FIGS. 5A and 5B show volumes of the other end of the third half-finished product increased 10-18% respectively.
Figure 5B:
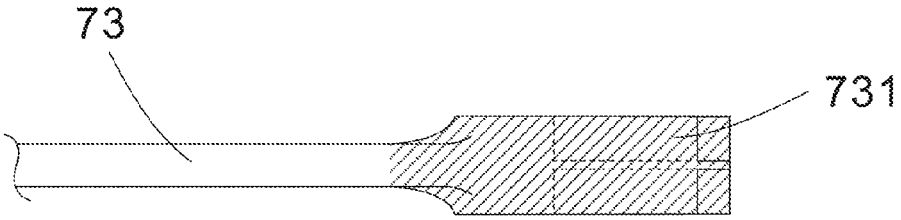

As shown in FIGS. 5A and 5B, inclined lines 731 show volumes of the other end of the third half-finished product 73 are increased 10-18%.

Figure 6A:
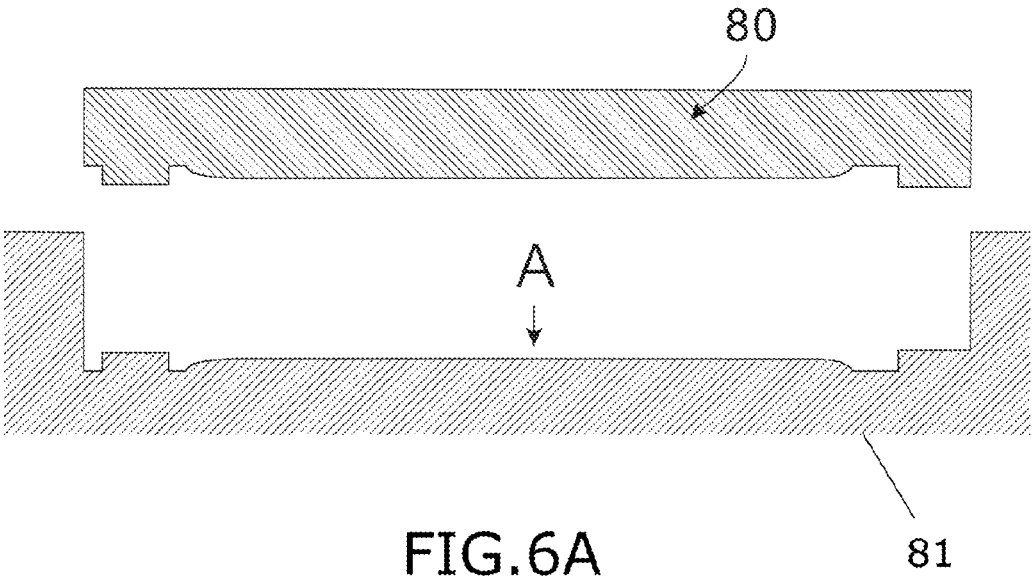
FIG. 6A shows the die to be placed on a mold along a direction A.

As shown in FIG. 6A, a die 80 is to be placed on the mold 81 along a direction A.

Figure 6B:
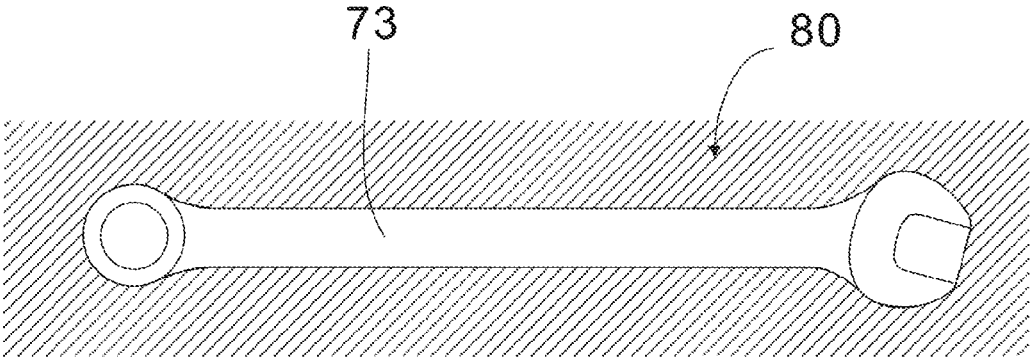
FIG. 6B shows a cavity shaped as the third half-finished product in the die.

As shown in FIG. 6B, a cavity shaped as the third half-finished product 73 is formed in the die 80.

Figure 7A:
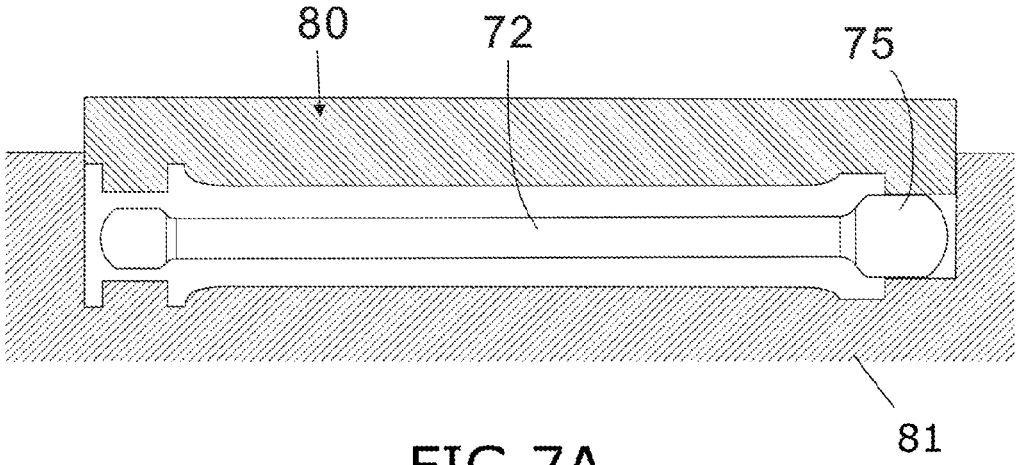
FIG. 7A shows the second half-finished products placed in a space defined by and between the die and mold.

As shown in FIG. 7A, the second half-finished product 72 is placed in a space defined by and between the die 80 and mold 81.

Figure 7B:
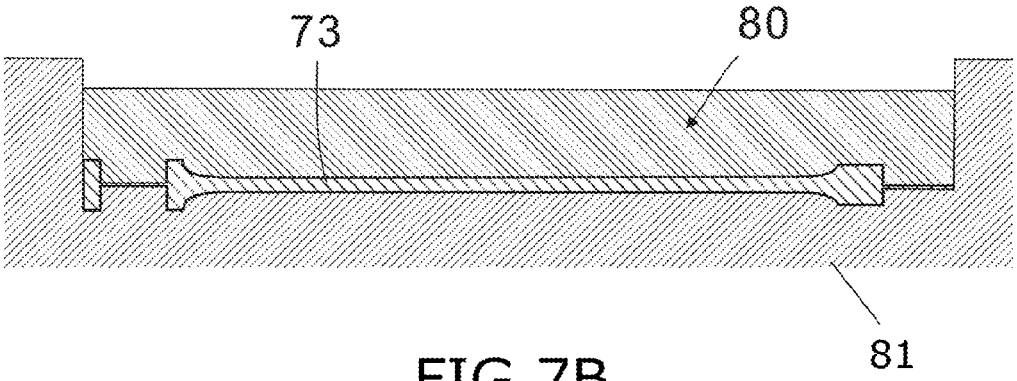
FIG. 7B shows the die pressed on the second half-finished product to form the third half-finished product.

As shown in FIG. 7B, the die 80 is pressed on the second half-finished product 72 to form the third half-finished product 73.

Figure 7C:
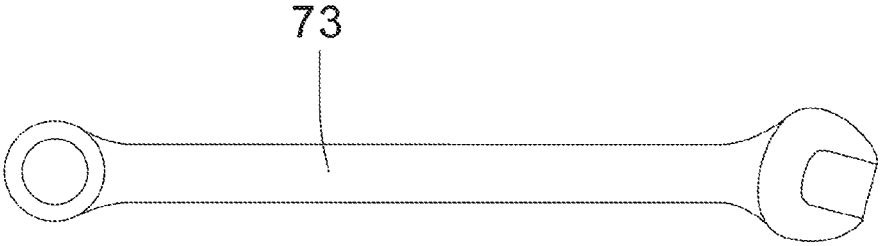
FIG. 7C is a perspective view of the third half-finished product.

As shown in FIG. 7C, the third half-finished product 73 is shown.

Figure 8:
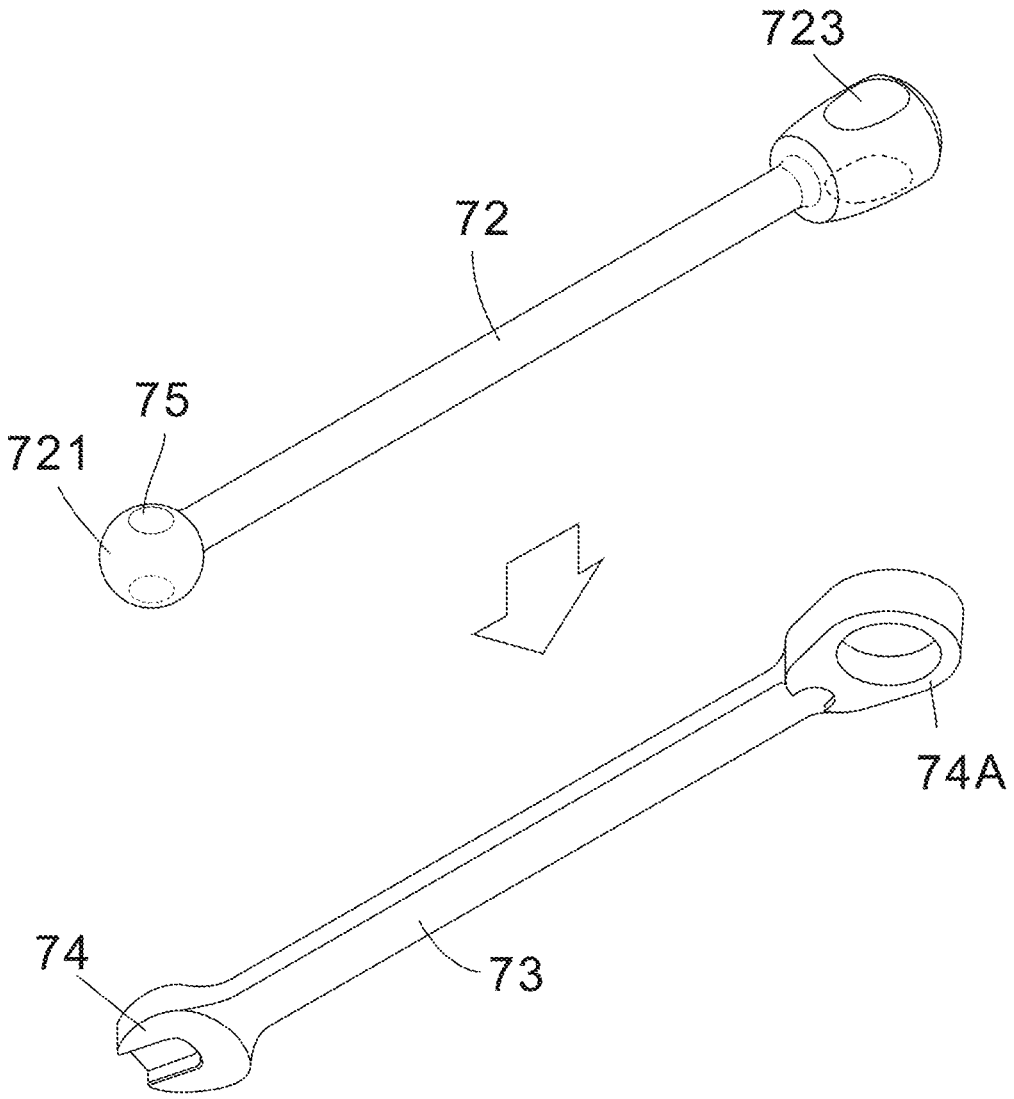
FIG. 8 schematically shows the second half-finished product having the other end shaped as a cylinder having a bulged intermediate portion, and the second half-finished product formed as the third half-finished product having a half-finished open end and a half-finished box end.

As shown in FIG. 8, the second half-finished product 72 has the other end 723 shaped as a cylinder having a bulged intermediate portion. Further, the second half-finished product 72 is formed as the third half-finished product 73 having a half-finished open end 74 and a half-finished box end 74A.

As shown in FIG. 9, the second half-finished product 72 has the other end 723 shaped as a cylinder having a bulged intermediate portion, and top and bottom flats 75. Further, the second half-finished product 72 is formed as the third half-finished product 73 having a half-finished box end 74A.

While the invention has been described in terms of preferred embodiments, those skilled in the art will recognize that the invention can be practiced with modifications within the spirit and scope of the appended claims.

What is claimed is:

1. A processes of manufacturing wrenches, the process comprising the steps of:

preparing a cylinder of raw material;

cutting the cylinder of raw material into a plurality of cylindrical first half-finished products;

increasing volumes of two one ends of each first half-finished product 10-18% by compressing to form a second half-finished product including two spheres at two ends respectively, each sphere having top and bottom flats;

sintering the second half-finished product;

placing the second half-finished product in a die;

forging the second half-finished product to form a third half-finished product; and punching the third half-finished product to form a finished wrench having an open end and a box end.

* * * * *